US006966080B2

(12) United States Patent
Connell et al.

(10) Patent No.: US 6,966,080 B2
(45) **Date of Patent: *Nov. 22, 2005**

(54) BED STRUCTURE WITH STORAGE AREA

(76) Inventors: Michelle D. Connell, 4018 Highway 34, Wheatland, WY (US) 82201; Brian A. Connell, 4018 Highway 34, Wheatland, WY (US) 82201; Fred M. Meyer, 4016 Highway 34, Wheatland, WY (US) 82201; Douglas S. Meyer, 4018 Highway 34, Wheatland, WY (US) 82201; Frank L. O'Brien, 4459 Pursel Dr., Casper, WY (US) 82604

( * ) Notice: Subject to any disclaimer, the term of this patent is extended or adjusted under 35 U.S.C. 154(b) by 0 days.

This patent is subject to a terminal disclaimer.

(21) Appl. No.: 10/391,091

(22) Filed: Mar. 18, 2003

(65) Prior Publication Data

US 2003/0226203 A1 Dec. 11, 2003

Related U.S. Application Data

(63) Continuation-in-part of application No. 10/146,153, filed on May 15, 2002, now Pat. No. 6,611,973.

(60) Provisional application No. 60/291,030, filed on May 15, 2001.

(51) Int. Cl.[7] ..... A47C 19/20; A47C 17/50; A47C 19/22

(52) U.S. Cl. ..... 5/9.1; 5/503.1; 211/96; 211/168; 248/304

(58) Field of Search ..... 5/503.1, 658, 2.1, 5/9.1, 308, 58, 931; 211/168, 96; 248/304

(56) References Cited

U.S. PATENT DOCUMENTS

| | | | | |
|---|---|---|---|---|
| 239,465 | A | 3/1881 | Delany | |
| 1,231,452 | A * | 6/1917 | Sword | 211/107 |
| 1,391,566 | A | 9/1921 | Musselman | |
| 1,865,757 | A * | 7/1932 | Honsowetz | 248/286.1 |
| 2,593,567 | A * | 4/1952 | Keck | 211/119.06 |
| 2,692,009 | A | 10/1954 | Warshaver | |
| 3,311,932 | A | 4/1967 | Ahola | |

(Continued)

FOREIGN PATENT DOCUMENTS

GB 451482 8/1936

*Primary Examiner*—Alexander Grosz

(74) *Attorney, Agent, or Firm*—Lathrop & Gage, L.C.

(57) ABSTRACT

A bedding assembly is provided having an integrated storage area. The assembly has one or more platforms having a recessed storage area and a deck pivotably mounted to the platform. The deck may be pivoted over the platform between a horizontal position where a use can lie upon the deck, such as for sleeping, and a non-horizontal position to allow access to the storage area of the platform. The platforms may be coupled together at a distance from one another by a pair of end frames. Optionally, garment hooks may be rotatably mounted onto the bed assembly and rotatable between a use position, for hanging items thereon, and a stowage position.

27 Claims, 8 Drawing Sheets

U.S. PATENT DOCUMENTS 4,219,177 A 8/1980 O'Day
4,312,086 A * 1/1982 Bianco ..... 5/2.1
4,686,727 A 8/1987 Wilkinson
4,745,643 A 5/1988 Clarke
4,811,438 A 3/1989 Simpson
4,928,332 A 5/1990 Ogden et al.
5,003,650 A * 4/1991 Caya ..... 5/9.1
5,020,173 A 6/1991 Dreyer, Jr.
D342,393 S 12/1993 Cephas
D441,559 S 5/2001 Walsh
6,314,595 B1 * 11/2001 Price ..... 5/201
6,502,255 B1 * 1/2003 Perkins et al. ..... 5/9.1

* cited by examiner

BED STRUCTURE WITH STORAGE AREA

RELATED APPLICATIONS

This application claims priority to U.S. application Ser. No. 10/146,153, filed May 15, 2002, now U.S. Pat. No. 6,611,973, which claims priority to U.S. provisional application Ser. No. 60/291,030, filed May 15, 2001, all of which are incorporated herein by reference.

BACKGROUND OF THE INVENTION

This invention relates generally to bedding structures and, more particularly, to an bedding structure having a storage area formed integrally therewith.

DESCRIPTION OF THE RELATED ART

Bedding assemblies have been configured with areas for storage of various item, such as clothing, linens, personal effects, etc. These designs typically comprise "pull-out" or other similar drawer designs located beneath framing members that support a mattress thereon. U.S. Design Pat. No. D379,877, or Tilley, is an example of a bunk bed design where a set of drawers are positioned beneath a lower platform, the contents of such drawers being accessed by pulling the drawers out from underneath the bed dram. Similarly, U.S. Pat. No. 4,811,438, of Simpson, discloses a storage unit for a bed assembly comprising a number of pull-out drawers supported by rail members mounted to an underside of a bed frame.

Unfortunately, storage solutions for bedding are often inconvenient for storage and retrieval of items in tight quarters, such as in a dorm room, a sea faring vessel, military barracks, hospital room, or other similar arrangement. Storage solutions employing drawers are also susceptible to being accidentally slid out form the bedding assembly when, for example, the surface upon which the bedding is located encounters turbulence, such as aboard a ship or other moving object. Additionally, bedding assemblies having storage areas lack a simple and quick method for assembly and disassembly of the frame structure.

SUMMARY OF THE INVENTION

The present invention provides a bedding assembly having a storage area integrated therewith. In one aspect, the assembly comprises one or more platforms having a recessed storage area and a deck pivotably mounted to the platform. The deck may be pivoted over the platform between a horizontal position where a use can lie upon the deck, such as for sleeping, and a non-horizontal position to allow access to the storage area of the platform.

In another aspect, the bedding assembly provides a storage solution for a bunk bed type arrangement. The assembly comprises upper and lower platforms, a deck pivotably mounted at least one of the platforms, a pair of end frames extending between the upper and lower platforms, and a pair of base supports. The upper and lower having sleeves formed generally at perimeter corners thereof, and at least one of the platforms has a recessed storage area. The platform having the recessed storage area also has the pivotably mounted deck thereon to allow access to the storage area; the deck being pivotable between a horizontal position wherein a user may lie thereon and a non-horizontal position for access to the storage area by the user. To rigidly couple the upper and lower platforms together, the end rams have vertical posts and at least one horizontal cross member formed therebetween, the vertical posts of the end frames being slidably received into the sleeves of the platforms. Like the end frames, the base supports have first and second vertical posts of the based supports being slidably received into the sleeves of the lower platform and configured to support the weight of the bed assembly.

In another aspect, the bedding assembly has a rotatable garment hook mounted thereon to provide a device for hanging various items from the assembly. The garment hanger is rotatable between a use position and a stowage position.

DETAILED DESCRIPTION OF THE INVENTION

Figure 1:
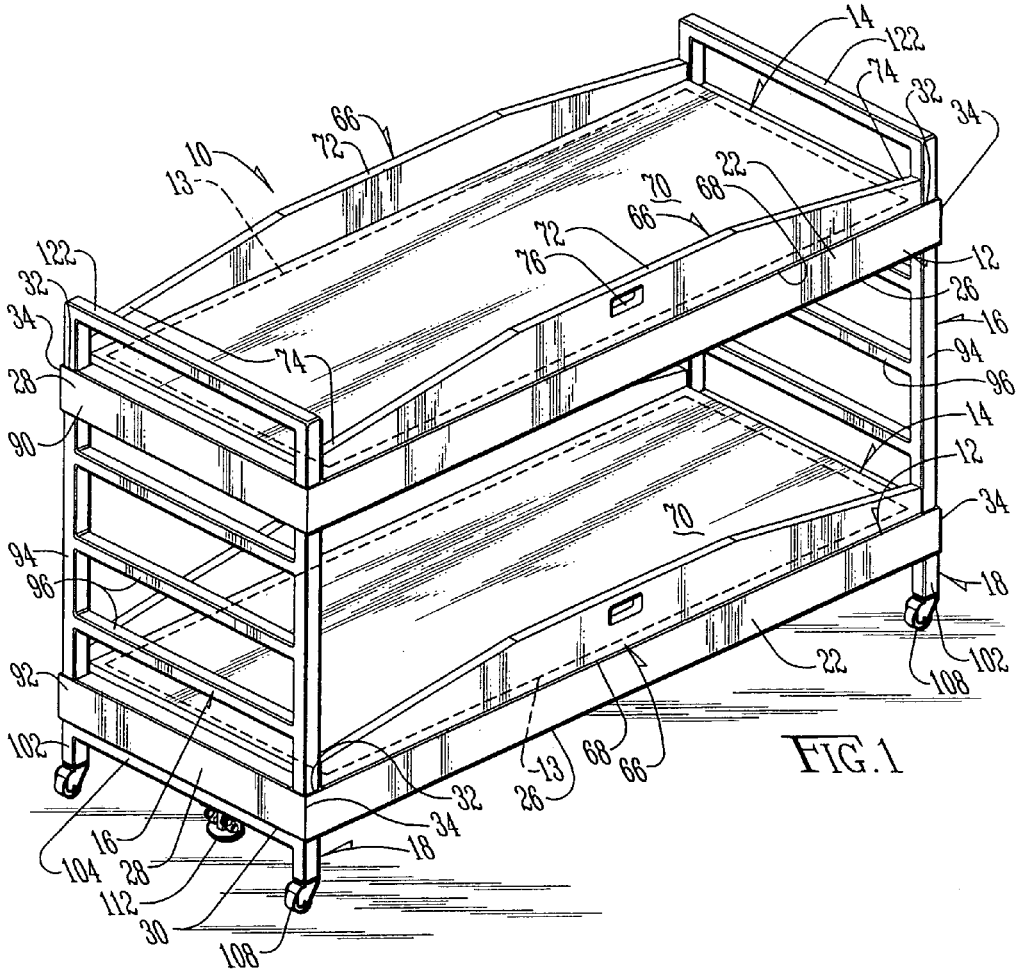
FIG. 1 is a perspective view of a bedding assembly in accordance with an embodiment of the present invention.
Figure 2:
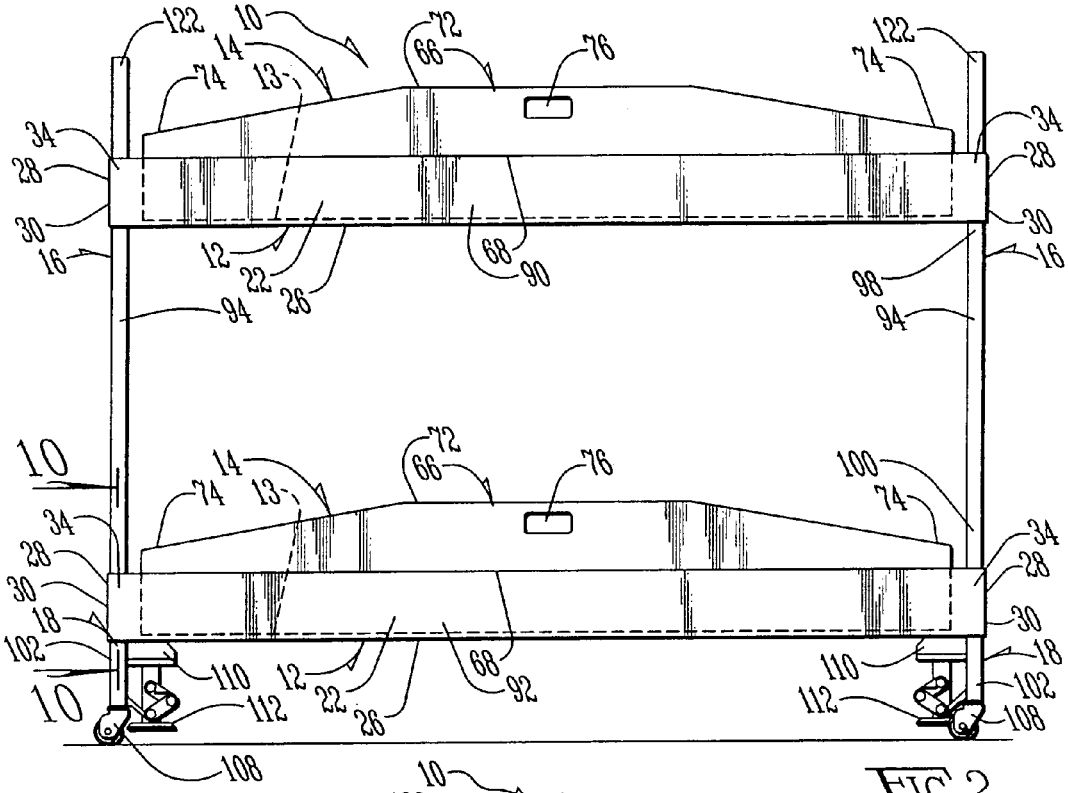
FIG. 2 is a front elevational view of the bedding assembly in accordance with an embodiment of the present invention.
Figure 3:
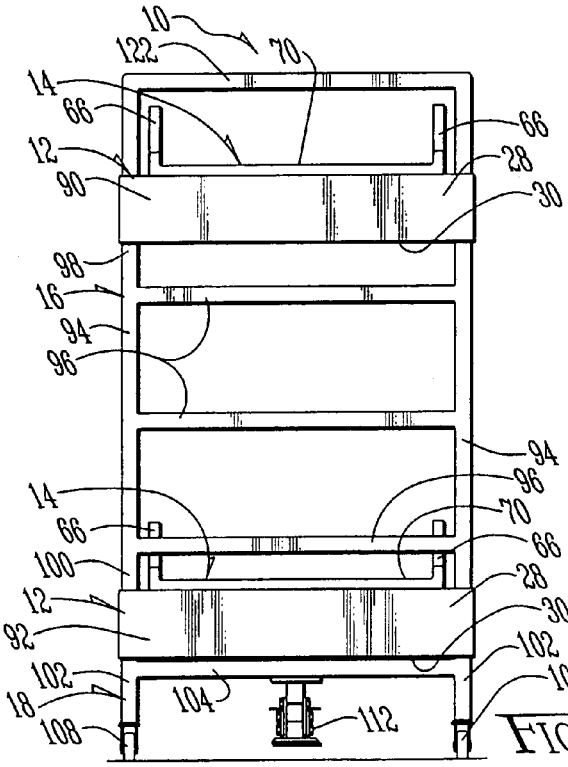
FIG. 3 is a side elevational view of the bedding assembly in accordance with an embodiment of the present invention.

The bedding assembly of the present invention having a storage area integrated therewith is shown generally at 10 in FIGS. 1–3. The assembly 10 comprises one or more platforms 12 having a recessed storage area 13 and a deck 14 pivotably mounted to the platforms 12. A mattress (not shown) or similar bedding structure may be placed upon the deck 14 to provide a comfortable sleeping surface. Optionally, a pair of end frames 16 may be employed to interconnect multiple platforms 12 to form a multi-tier bed, and a pair of base supports 18 are configured to support the weight of the assembly 10 thereon. The deck 14 rotates between a horizontal position where such deck is resting upon the platform 12 to enclose the storage area 13, and a non-horizontal or angled "open" position whereby the deck is rotated above and away from a direct, overlying relationship with the platform to allow for access to the storage area. The components of the assembly 10 can be made of various materials, such as metals, wood, etc.

Figure 5:
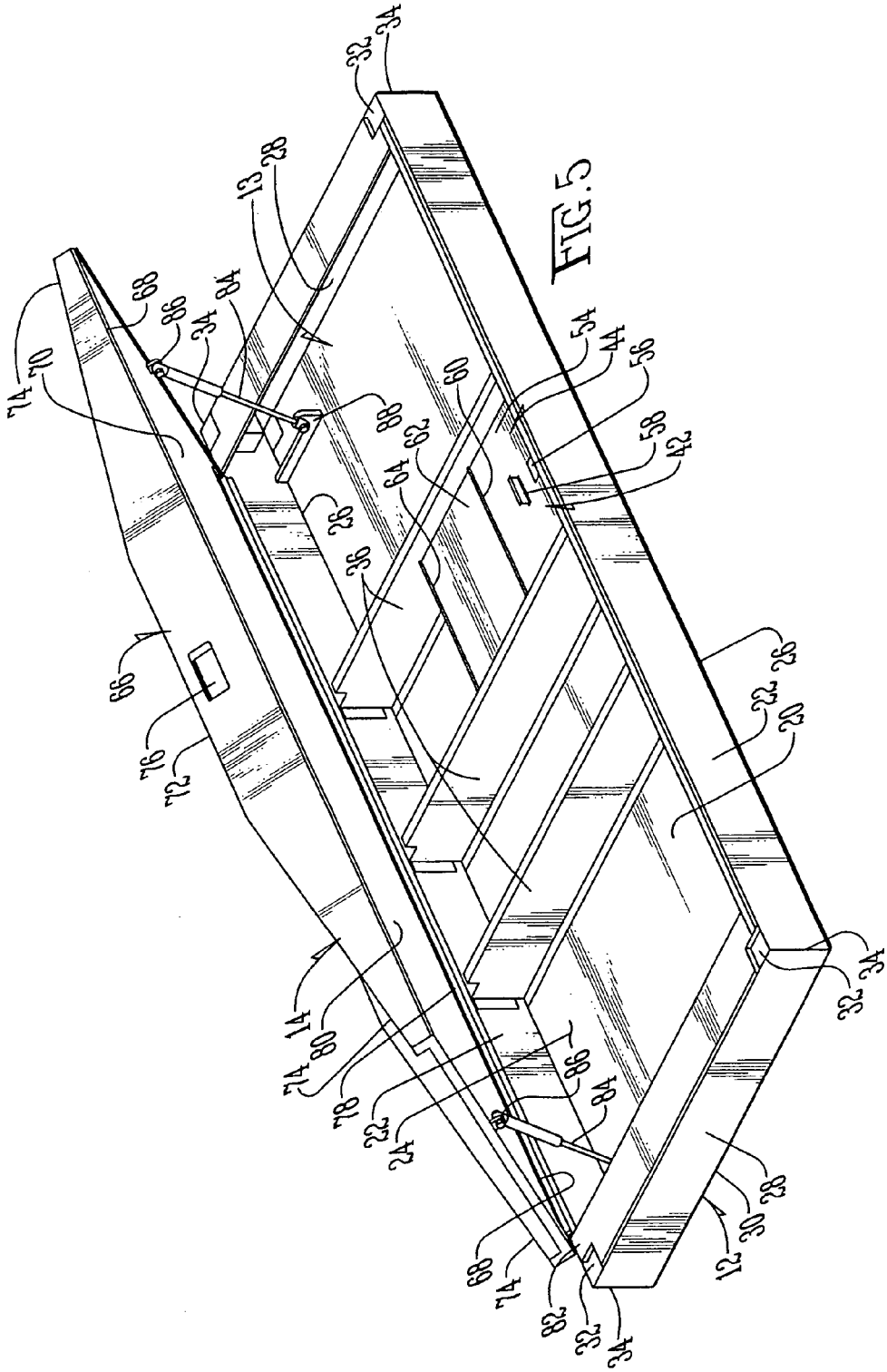
FIG. 5 is a perspective view of the platform and deck of the present invention showing the deck pivoted to a non-horizontal position.

As seen in FIG. 5, platform 12 has a generally planar, rectangular base shelf 20 upon which items to be stored may be placed. Parallel sidewalls 22 are disposed on an upper surface 24 of the base shelf 20 and extend generally along longitudinal side edges 26 of the base shelf. Similarly, parallel endwalls 28 are disposed on the base shelf upper surface 24 and extend generally along transverse end edges 30 of the base shelf. In this arrangement, the sidewalls 22 and endwalls 28 extend around the perimeter of the base shelf 20 and cooperate to define the storage area 13 therebetween. The sidewalls 22 and endwalls 28 may be connected to the platform 12 by various means, such as fasteners or adhesives, or if these components are made of metal, by welding them together. Fasteners, as used with various components of the bedding assembly 10, refer to configurations such as a bolt and nut configuration, a bolt and locking washer configuration, or other similar designs.

The platform 12 may also have a plurality of sleeves 32 to allow the end frames 16, the base supports 18, and other components of the bedding assembly 10 to be connected to the platform 12 through insertion therein. The sleeves 32 are preferably formed with, or attached to, the base shelf upper surface 24 near perimeter corners 34 of the base shelf 20, and may have various cross sectional shapes, such as circular, rectangular, hexagonal, octagonal, etc., so long as the shape is the same as the components that are inserted therein. In one aspect, connection between the sleeves 32 and the bedding assembly components is accomplished by providing a plurality of apertures extending horizontally at least partially therethrough such that fasteners may be inserted into such apertures to interconnect the platform 12 to the desired assembly component. Mounting brackets 37 having apertures therethrough may be positioned within the sleeves 32 such that the apertures are aligned with the apertures of the sleeve 32 and the bedding assembly component to provide a mating surface for the assembly component within the sleeve upon attachment thereto. As with the sidewalls 22 and endwalls 28, the sleeves 32 may be connected to the platform 12 by fasteners or welding if the sleeves and platform are made of metal. In another aspect, the platform 12 and components thereof may be formed from a single piece of metal, such as by stamping.

Figure 6:
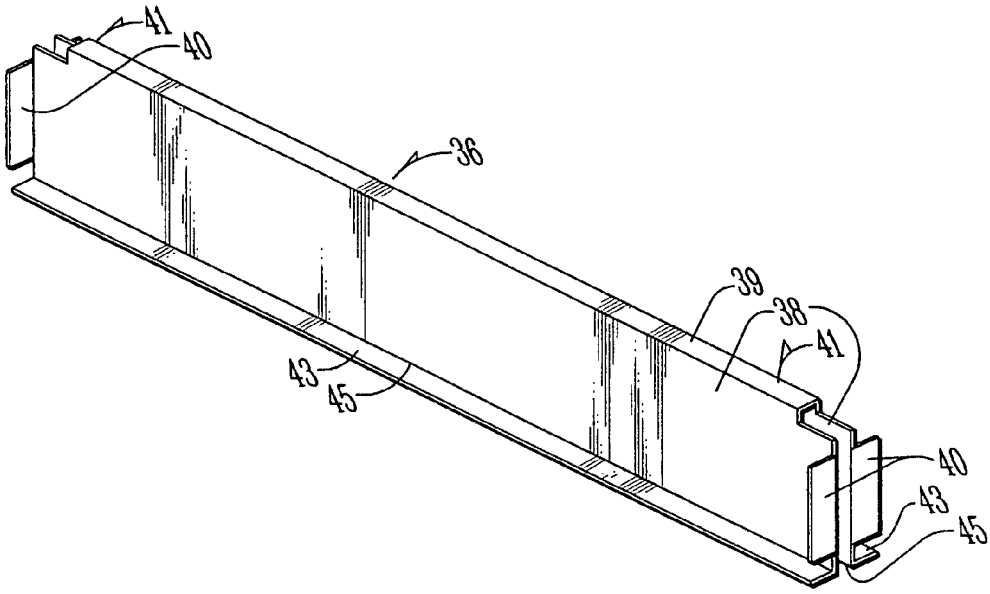
FIG. 6 is a perspective view of a divider of the present invention.

To allow for segregation of stored items in the storage area 13 of platform 12, dividers 36 can be extended transversely across the storage area on the base shelf 20 and between the longitudinal sidewalls 22 to form individual storage regions. FIG. 6 shows a close-up view of a single divider 36. The divider 36 has a pair of web sections 38 extending downward from an interconnecting upper member 39, lateral flanges 40 extending orthogonally from opposite longitudinal ends 41 of the web sections, and a base flange 43 extending orthogonally from the lower edge 45 of each of the web sections. Web sections 38 of adjacent dividers 36 form divider walls to define an individual storage region. The lateral flanges 40 of each web section 38 are configured to abut the sidewalls 22, the base flanges 43 are configured to rest upon the base shelf 20, and the upper member 39 is configured to abut the deck 14 when such deck is in a mating, overlying position relative to the platform 12 (i.e., the "horizontal" position). These flanges 40, 43 aid in bracing the divider 36 as well as providing a surface area for welding or otherwise attaching the divider to the base shelf 20 and the sidewalls 22. The dividers 36 are spaced apart so as to provide individual storage regions of desired sizes based on the dimensions of items that are to be stored in the platform 12.

Figure 7:
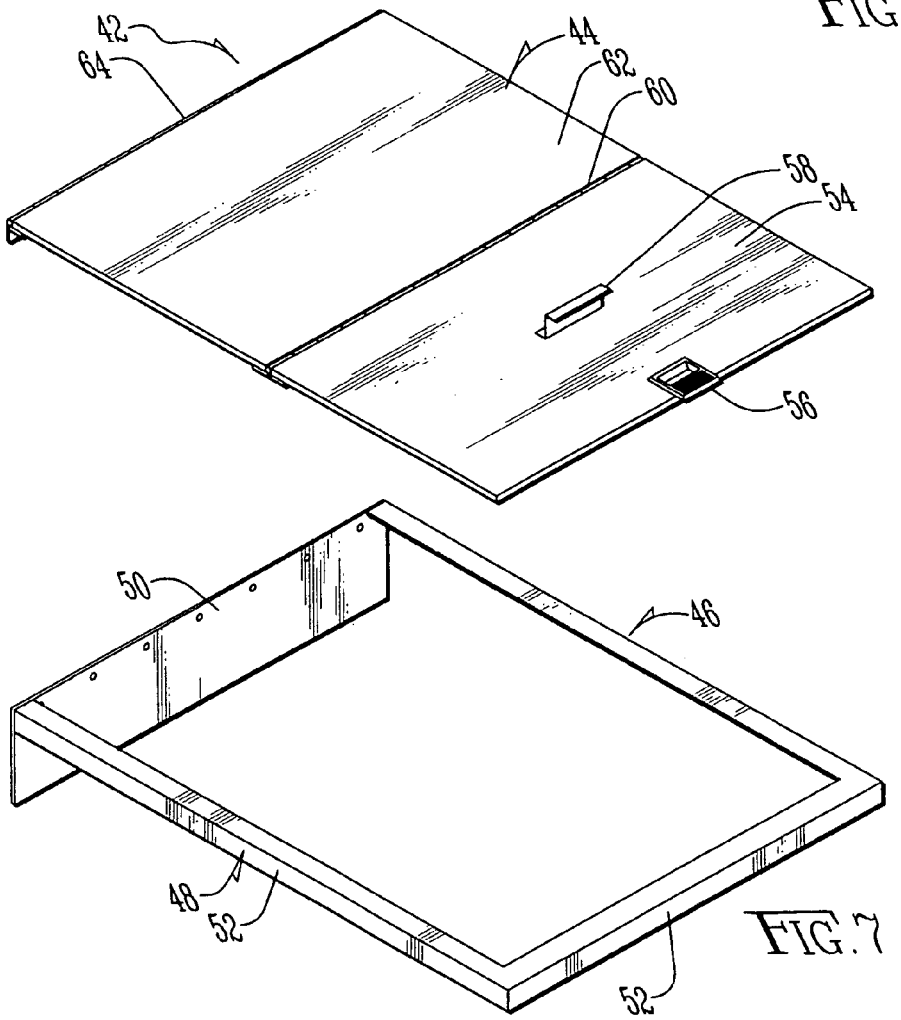
FIG. 7 is an exploded view of a lockbox of the present invention.

As seen in FIG. 7, a lockbox 42 can be provided in the storage area 13 to securely hold certain items and to limit access to such items. The lockbox 42 is formed by positioning a 2-hinged door member 44 and surrounding frame 46 on the base shelf 20 between two adjacent dividers 36 and abutting against one of the sidewalls 22 to define a secure region therein. The frame 46 has a outer rail 48, a downwardly extending plate 50, and flanges 52 extending orthogonally from the rail and plate. The flanges 52 are configured to abut one of the sidewalls 22 and adjacent dividers 36 to provide a surface area for welding or otherwise attaching the lockbox 42 to the sidewall 22 and dividers 36. A first plate 54 of the door member 44 has a lock mechanism 56 that secures the position of the first plate relative to the frame 46. A handle 58 may also be affixed to the first plate 54 to allow for rotation of the plate about a first hinge 60 to allow access to the secure region. Alternatively, an upward pulling force can be applied to the handle 58 to upwardly displace the first plate 54 and simultaneous rotate a second plate 62 about a second hinge 64 to enable access to the secure region.

Figure 8:
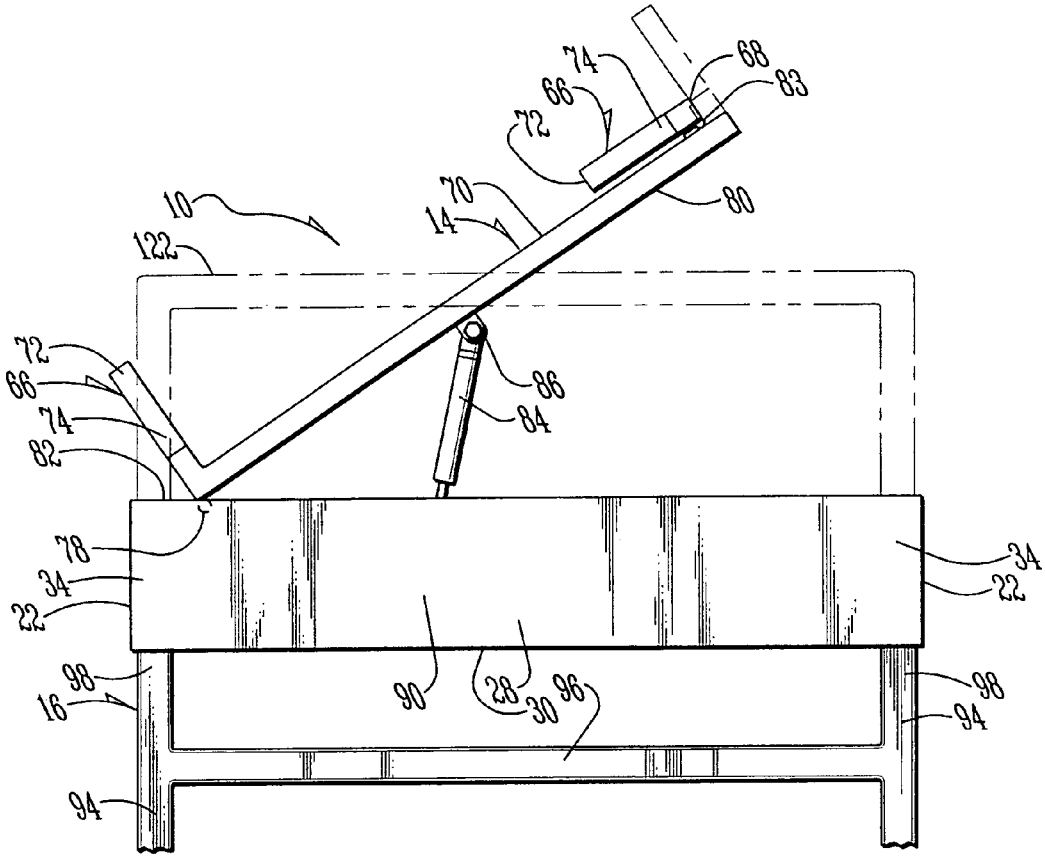
FIG. 8 is a side elevational view of the deck of the present invention showing a side guard pivotably mounted to the deck.

The deck 14 is best seen in FIGS. 1 and 2, and has two opposing side guards 66 extending from longitudinal side edges 68 of a planar section 70. The side guards 66 inhibit an occupant on the deck 14 from rolling off of such deck 14 and keep a mattress or similar bedding structure from sliding off of the deck when it is pivoted to a non-horizontal position to allow access to the storage area 13 of the platform 12. The side guards 66 preferably taper in height above the planar section 70 from a central region 72 towards opposite transverse side edges 74 of the deck 14, facilitating access to corners of a mattress for "bed making" or for accessing other items placed upon the deck. However, it is to be understood that the side guards 66 may only extend a portion of the distance along the longitudinal side edges 68 from the central region 72 and not completely to the transverse side edges 74. A handle 76, in the form of an aperture, may be formed in one of the opposing side guards 66 that is opposite from the longitudinal side edge 68 where the deck 14 is pivotably mounted to the platform 12. The handle 76 provides an area where a user can grip the side guard 66 to apply an upward force to rotate the deck 14 away from the horizontal position to access the recessed storage area 13. A hinge 78 provides the mechanism for pivotably mounting the deck 14 to the platform 12. The hinge 78 may be mounted to an undersurface 80 of the deck 14 and to a top ledge 82 of one of the parallel sidewalls 22. As shown in FIG. 8, a hinge 83 may also be attached to a lower surface 85 of the side guards 66 and to the deck 14 to allow the side guards to be pivotably rotated to lie flat against the deck to provide additional vertical clearance for a deck rotated upwardly and away from the horizontal position. In one aspect, the deck 14 is made of wood and the side guards 66 are affixed to the deck using fasteners or adhesives.

To assist in rotation of the deck 14 away from horizontally overlying the platform 12 to expose the storage area 13, and to assist in returning the deck to the horizontal position to enclose the storage area, one or more lift mechanisms 84 are provided. As seen in FIG. 5, the lift mechanism 84 may be an gas or air spring, or other lift assisting device. The lift mechanism 84 applies a force to upwardly displace a mounting block 86 affixed to deck 14, thereby rotating the deck away from the horizontal position. A bracing arm 88 is affixed to the base shelf 20 of the platform 12 to attach to the lift mechanism 84 on an end opposite of the mounting block 86 to provide a structure that the lift mechanism can "push-off" of for extension. Fasteners can be used to attach the lift mechanism 84 to the mounting block 86 and bracing arm 88.

Figure 4:
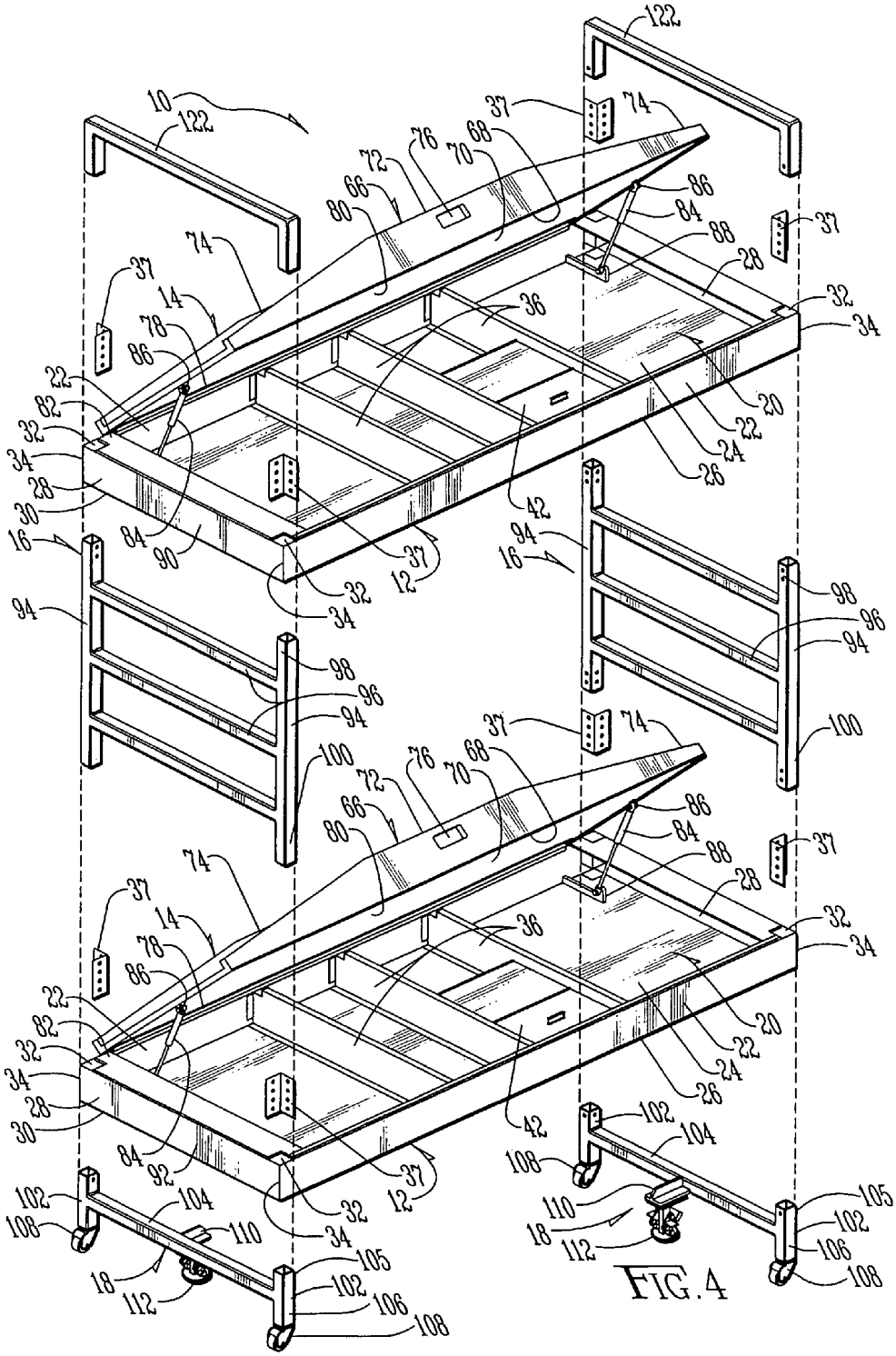
FIG. 4 is an exploded view of the bedding assembly in accordance with an embodiment of the present invention.

In the aspect of the present invention employing two or more platforms 12, the end frames 16 and base supports 18 provide the structure to form a multi-tier or "bunk" bed. FIG. 4 shows an exploded view of the elements of assembly 10 in accordance with this aspect. One of each of the end frames 16 is generally located at opposing longitudinal ends of the platforms 12. Likewise, one of each of the base supports 18 is generally located at opposing longitudinal ends of a lower platform 12 adjacent to the floor upon which the assembly 10 is resting. Each pair of end frames 16 extend vertically between an upper platform 90 and a lower platform 92. The height of an occupant space for the lower platform 92 is generally defined by the height of an end frame 16 minus the distance the end frame extends into the sleeves 32 of the upper and lower platforms 90, 92. Each end frame 16 comprises a pair of vertical posts 94 and at least one cross-member 96 extending therebetween. Attachment of the cross-member 96 to the pair of vertical posts 94 may be accomplished by, for example, welding or other attachment means. The cross-member 96 is preferably horizontal in orientation such that it may serve as a step or latter for an occupant to reach the upper platform 90, but could have another shape so long as the cross-member provides a brace to laterally support the vertical posts 94. Also, the spacing between cross-members 96 is ideally such that each members form together a latter. Both the vertical posts 94 and the cross-member 96 are preferably tubular structures, and the vertical posts 94 have a cross-sectional shape that matches the shape of the sleeves 32 of the platforms 12 such that the posts—having a correspondingly smaller cross-sectional dimension that the inside of the sleeves 32—may be slidingly received by such sleeves. Upper and lower regions 98, 100 of the vertical posts have horizontal apertures extending at least partially therethrough to match the apertures of the sleeves 32 of upper and lower platforms 90, 92 and accept fasteners inserted therein to couple the upper and lower platforms together at a specific distance. Multiple apertures may be disposed along each of the upper and lower regions 98, 100 such that the posts 94 can be extended for varying lengths into the platform sleeves 32 to coupled together the upper and lower platforms 90, 92 at a range of distances depending on the needs of the occupant.

Figure 9:
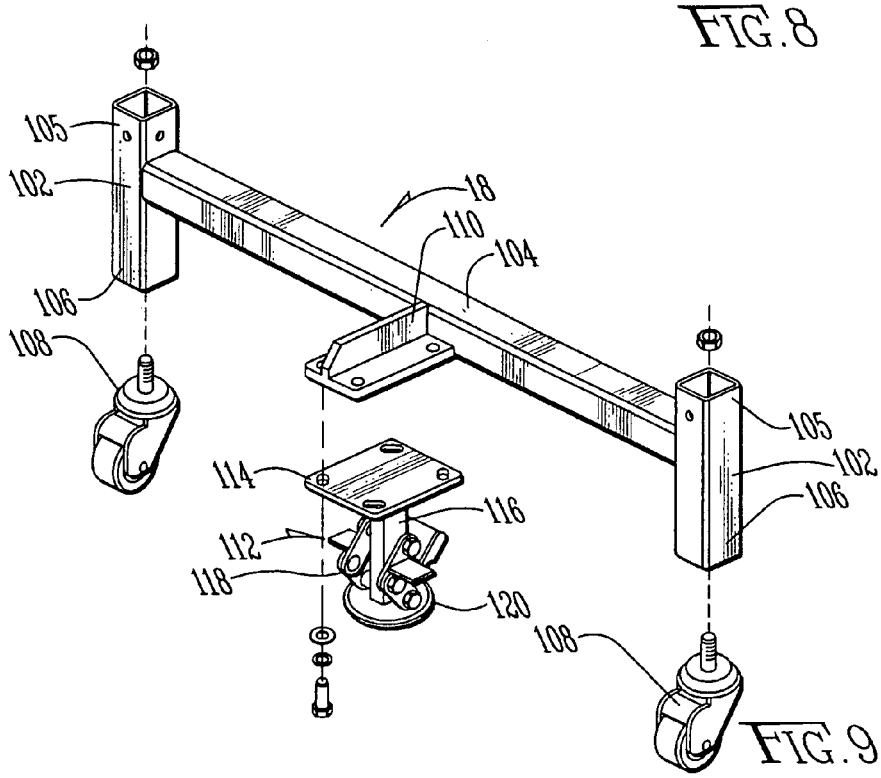
FIG. 9 is an exploded view of a base support of the present invention.

The base support 18, as seen in FIG. 9, comprises a pair of vertical posts 102 and a cross-member 104 similar to the end frames 16, and are preferably tubular. A pair of base supports 18 are preferably employed for each bedding assembly 10. Upper regions 105 of the vertical posts 102 are slidably received into the sleeves 32 of the lower platform 92; lower regions 106 of the vertical posts 102 contact a surface upon which the assembly 10 is located to transfer the weight load of the assembly to the surface. Preferably, a set of casters 108 are mounted to the vertical post lower regions 106 to transfer the weigh load to the underlying floor and allow for ease in movement of the assembly 10 across the floor to a specific location and facilitate a quick orientation of the assembly in rooms of varying geometry. Additionally, a mounting plate 110 may be affixed to the cross-member 104 to provide a structure upon which a locking footing 112 is attached. Preferably, the mounting plate 110 is positioned at about the mid-point along the cross-member 104 between the vertical posts 102. The locking footing 112 has an upper mating surface 114 for attachment to the mounting plate 110, a post 116 extending downward from the mounting plate, extensible linkages 118 mounted to the post to raise and lower the footing 112 to reach the underlying surface, and a bottom frictional pad 120 to contact the underlying surface and frictionally resist lateral movement of the assembly 10 across a surface. The locking footing 112 should be downwardly extensible to a position that is at least as low as the casters 108 relative to the underlying floor to at least partially take the weight load of the assembly 10 off of the casters 108 and prevent such casters 108 from rolling the assembly 10 across the floor. Attachment means, such as fasteners, may be used to attach the casters 108 to the vertical posts 102, and the locking footing 112 to the mounting plate 110.

If it is desired to have more that two platforms 12 in one bedding assembly 10 (i.e., more than an upper and lower platform 90, 92), an additional pair of end frames 16 may be positioned between the upper platform 90 and the third platform (not shown) having a deck 14 pivotably mounted thereon. This pattern of additional end frames 16 and platforms may be repeated as desired for a bedding assembly 10. If only upper and lower platforms 90, 92 are needed, a pair of U-shaped upper end guards 122 may be slidably received into the sleeves 32 of the upper platform 90 and connect thereto in a similar fashion as the vertical posts 94 of the end frames 16, as seen in FIG. 5. One of each of the upper end guards 122 is generally located at opposing longitudinal ends of the upper platform 90. Preferably, the upper end guards are tubular structures. Fasteners may be extended through apertures in the upper end guards 112 and the sleeves to couple the guards to the upper platform 90. It should also be understood that if more than two platforms are provided in an assembly 10, the upper end guards can be connected to the sleeves 32 of the uppermost platform 12.

Figure 10:
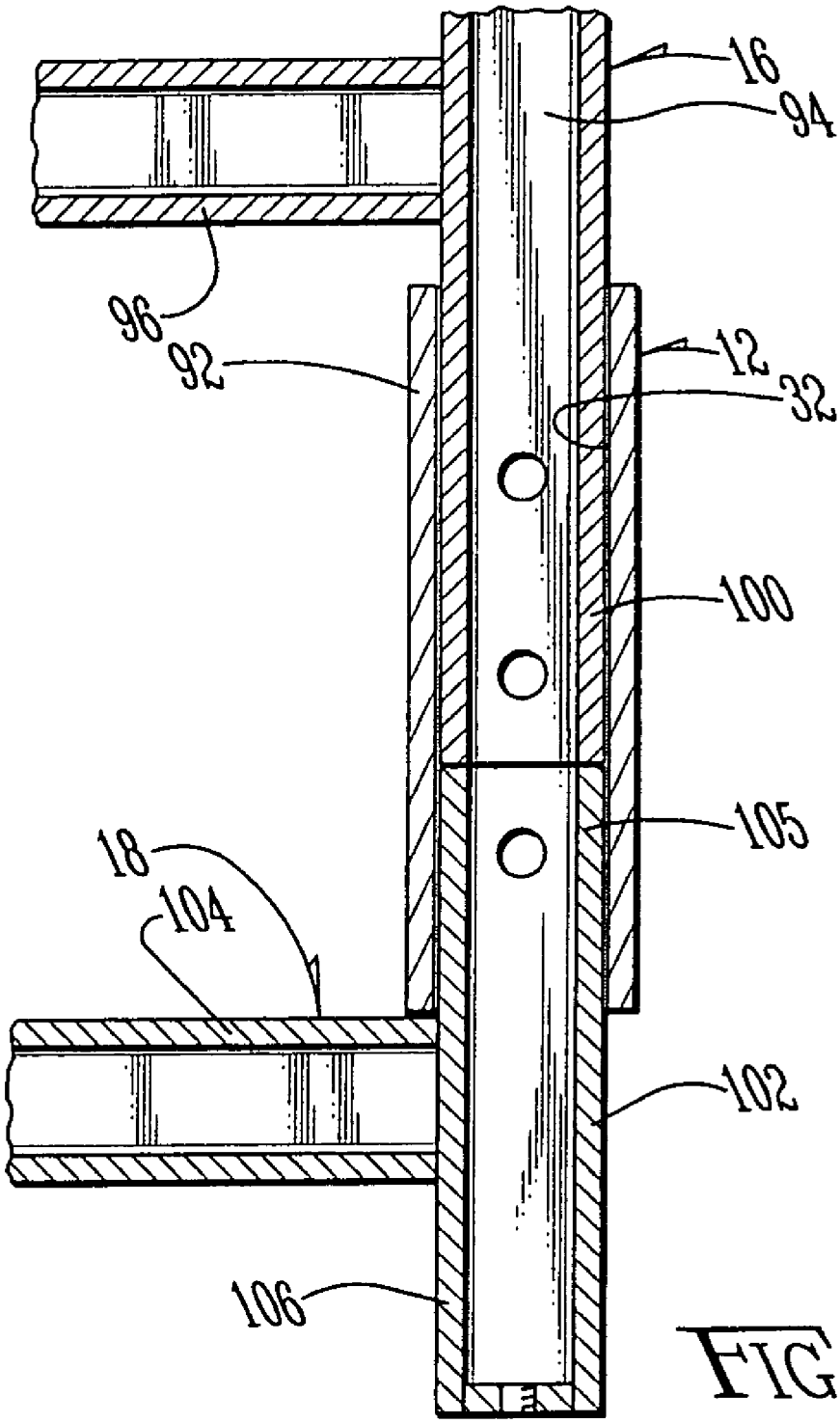
FIG. 10 is a cross-sectional view taken along line 10—10 showing an end frame and a base support inserted into a sleeve of a platform in accordance with an embodiment of the present invention.

In another aspect of the present invention shown in FIG. 10, the base supports 18, end frames 16, and upper end guards 112 may be configured to be inserted into the sleeves 32 of the platforms 12 a sufficient distance as to abut one another. This would allow direct transfer of the weight loads of the assembly 10 through the end frames 16 and the base supports 18 as opposed to each platform 12 carrying the load of platforms and other components of the assembly located above such platform through the fasteners thereof. Additionally, if it is desired to further speed assembly and disassembly of the present invention, the fasteners used to connect the base supports 18 and end frames 16 to the sleeves 32 of platforms 12 may be eliminated such that the platforms 12 are merely lowered onto the base supports 18 and the end frames 16 to rest thereon. More specifically, the sleeves 32 of the lower platform 92 are slid over the vertical posts 102 of the base support 18 until the platform abuts and rests on the base support cross-member 104. Likewise, the sleeves 32 of the upper platform 90 are slid over the vertical posts 94 of the end frames 16 until the platform abuts and rests on the uppermost end frame cross-member 96. The upper end guards 112 can also be slid into the sleeves 32 of the upper platform 90 without attachment by fasteners such that the guards can be easily removed by applying an upward force thereto.

Figure 11:
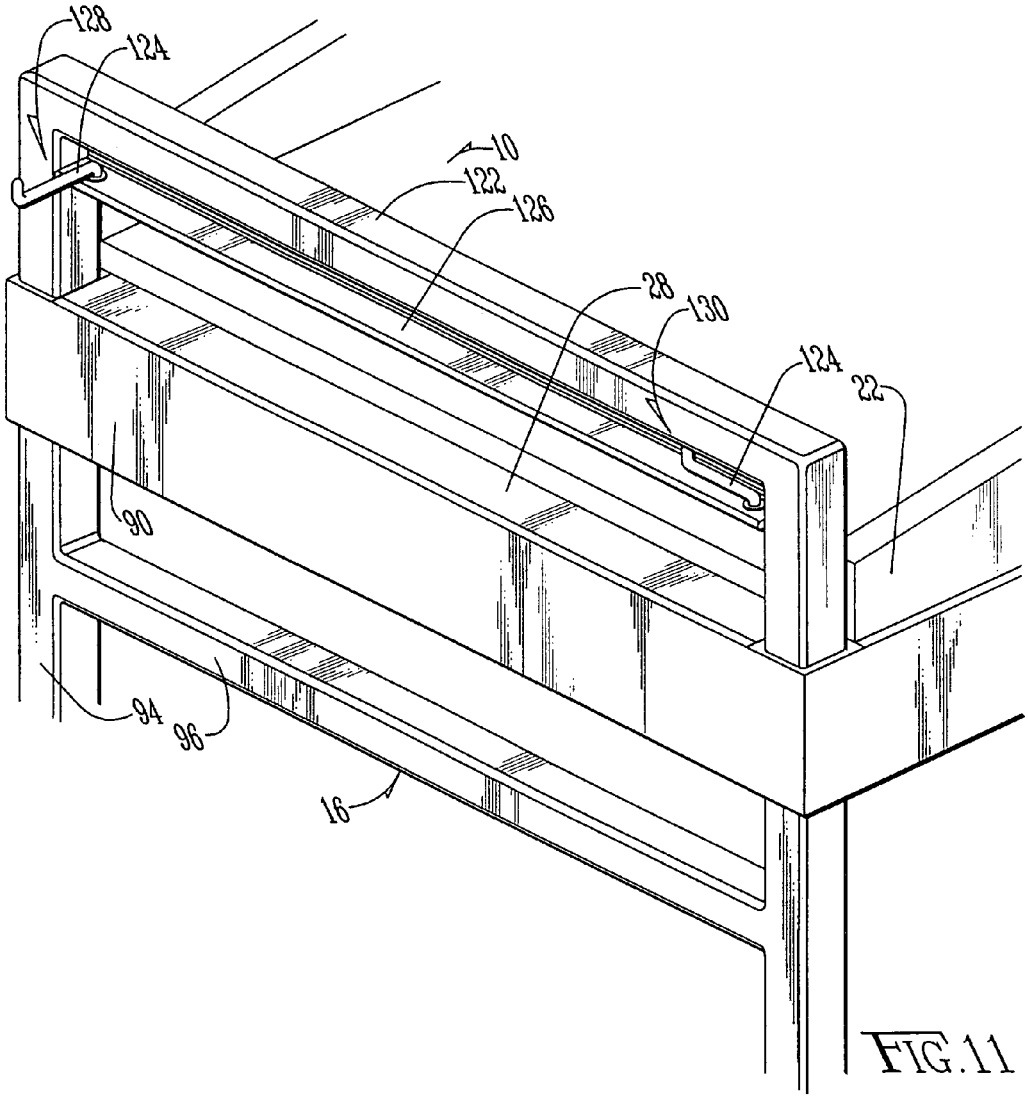
FIG. 11 is a partial side perspective view of the bedding assembly showing the garment hook.
Figure 12:
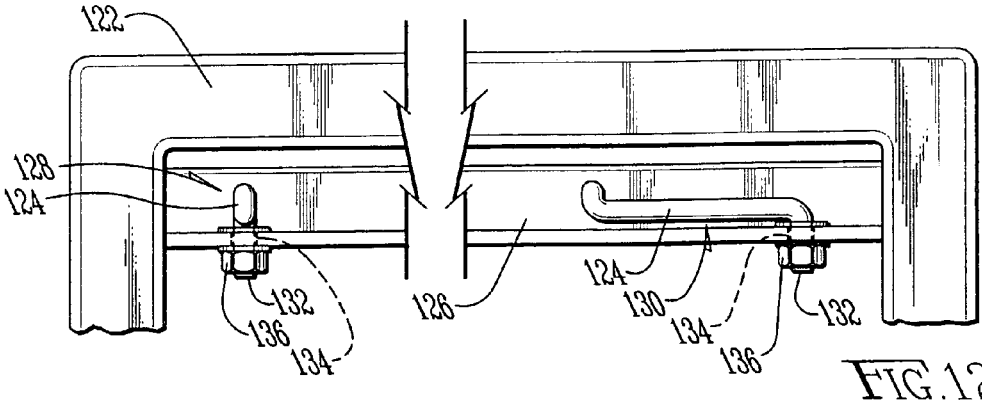
FIG. 12 is a partial side view of the bedding assembly showing the garment hook.

An additional feature that may be installed on the bedding assembly 10 is a garment hook 124 for hanging various items (e.g., garments on hangers) from the assembly. As seen in FIGS. 11 and 12, the garment hook 124 may be mounted onto a flanged angle member 126 extending across one of the upper end guards 122. More than one garment hook 124 may be mounted on each angle member 126 as needed, and angle members 126 may be formed at each of the upper end guards 122 at opposite ends of the bedding assembly 10. Additionally, the garment hooks 124 may also be mounted onto other points on the end frames 16 (e.g., mounted vertically through end frame cross-member 96), and other flanged angle members may be formed onto other locations on the end frames 16 to provide a location for mounting one or more garment hooks 124.

Each garment hook 124 may be rotatably mounted onto the angle member 126 so that the hook 124 can be rotated to a use position 128 extending outward from the angle member 126 for hanging various items thereon, and a stowage position 130 adjacent to the angle member 126 when the hook 124 is not in use so that movement around the bedding assembly 10 is not impeded and there is no danger of injury by a person running into the hook 124. Rotatable mounting of each garment hook 124 may be accomplished by extending a threaded region 132 of the hook 124 through a hole 134 in the angle member 126 and securing a nut 136 to the threaded region 132 to selectively position the hook 124 relative to the angle member 126. Loosening of the nut 136 allows for rotation of the garment hook 124 between the use position 128 and the stowage position 130. Once the garment hook 124 is positioned as needed, the nut 136 is tightened to lock the position of the hook 124.

The bedding assembly 10 of the present invention thus provides a more integrated bed structure and storage area. Pivotable mounting of the deck 14 to the platform 12 allows for easy access and viewing of items placed in the storage area 13. The assembly 10 may be configured with varying number of platforms 12 depending on the number of beds needed in a certain available space. For example, if a room has a floor with a small number of square footage, but the room has a large height, multiple platforms 12 may be arranged in a single assembly 10 such that sleeping and storage areas are maximized for a given amount of floor space. It is also to be understood that any one or more of the platforms 12 may be provided with out a pivoting deck 14 and recessed storage area 13 so long as at least one platform of the assembly 10 has a pivoting deck and recessed storage area. Further, while certain forms of the present invention have been illustrated and described herein, it is not to be limited to the specific forms or arrangement of parts described and shown.

What is claimed is:

1. A bed assembly, comprising:

upper and lower platforms coupled together at a distance from one another by a pair of end frames, at least one of the upper and lower platforms having a recessed storage area, the pair of end frames each having first and second vertical posts and at least one horizontal cross member formed therebetween;

a deck pivotably mounted to the at least one of the upper and lower platforms having a recessed storage area, the deck being pivotable between a horizontal position wherein a user may lie thereon and a non-horizontal position for access to the storage area by the user; the deck formed of a planar member having opposing side guards extending upwardly from longitudinal side edges thereof to inhibit a mattress from sliding off of the deck when it is pivoted to the non-horizontal position and one or more garment hooks rotatably mounted onto the bed assembly and rotatable between a use position and a stowage position.

2. The bed assembly of claim 1, wherein the one or more garment hooks are rotatably mounted onto the at least one horizontal cross member of the end frames.

3. The bed assembly of claim 1, further comprising a pair of upper end guards mounted onto the upper platform, the one or more garment hooks rotatably mounted onto one or more of the upper end guards.

4. The bed assembly of claim 3, wherein one or more of the upper end guards has a flanged angle member extending across the respective upper end guards, the one or more garment hooks rotatably mounted onto the flanged angle member.

5. The bed assembly of claim 1, further comprising at least one locking footing extensible in a downward direction from the bed assembly and configured to contact a surface and support at least a portion of the weight of the bed on the surface while frictionally resisting movement of the bed laterally across the surface.

6. The bed assembly of claim 5, further comprising first and second base supports mounted to the lower platform, the at least one locking footing being mounted to at least one of the first and second base supports.

7. The bed assembly of claim 6, further comprising a plurality of casters mounted to the first and second base supports to allow for movement of the bed across a surface.

8. The bed assembly of claim 1, wherein the recessed storage area is formed by a base shelf and a set of vertical walls extending from a perimeter of the base shelf, the bed assembly further comprising:

two or more dividers extending transversely across the base shelf from opposing vertical walls; and a lockbox formed between two adjacent dividers to securely position items therein.

9. The bed assembly of claim 1, wherein side edges thereof comprises a planar member having opposing side guards extending upwardly from longitudinal, one or more of the side guards have an aperture therethrough to facilitate gripping of the deck for pivoting thereof relative to the at least one platform.

10. The bed assembly of claim 1, wherein the first and second vertical posts are slidably received into sleeves formed generally at perimeter corners of the upper and lower platforms, the first and second vertical posts and sleeves having a plurality of horizontal apertures extending at least partially therethrough and configured to receive a plurality of fasteners.

11. The bed assembly of claim 1, further comprising a lift mechanism mounted to the at least one of the upper and lower platforms having a recessed storage area and the deck to assist in pivoting the deck from the horizontal position to the non-horizontal position.

12. A bed assembly, comprising:

upper and lower platforms coupled together at a distance from one another by a pair of end frames, at least one of the upper and lower platforms having a recessed storage area, the pair of end frames each having first and second vertical posts and at least one horizontal cross member formed therebetween; and a deck pivotably mounted to the at least one of the upper and lower platforms having a recessed storage area, the deck being pivotable between a horizontal position wherein a user may lie thereon and a non-horizontal position for access to the storage area by the user, the deck formed of a planar member having opposing side guards extending upwardly from longitudinal side edges thereof to inhibit a mattress from sliding off of the deck when it is pivoted to the non-horizontal position.

13. The bed assembly of claim 12, further comprising one or more garment hooks rotatably mounted onto the bed assembly and rotatable between a use position and a stowage position.

14. The bed assembly of claim 12, further comprising at least one locking footing extensible in a downward direction from the bed assembly and configured to contact a surface and support at least a portion of the weight of the bed on the surface while frictionally resisting movement of the bed laterally across the surface.

15. The bed assembly of claim 12, wherein the recessed storage area is formed by a base shelf and a set of vertical walls extending from a perimeter of the base shelf, the bed assembly further comprising:

two or more dividers extending transversely across the base shelf from opposing vertical walls; and a lockbox formed between two adjacent dividers to securely position items therein.

16. A bed assembly, comprising:

upper and lower platforms having sleeves formed therethrough, at least one of the upper and lower platforms having a recessed storage area;

a deck pivotably mounted to the at least one of the upper and lower platforms having a recessed storage area, the deck being pivotable between a horizontal position wherein a user may lie thereon and a non-horizontal position for access to the storage area by the user, the deck formed of a planar member having opposing side guards extending upwardly from longitudinal side edges thereof to inhibit a mattress from sliding off of the deck when it is pivoted to the non-horizontal position; and a pair of end frames each having first and second vertical posts and at least one horizontal cross member formed therebetween, the first and second vertical posts being slidably received into the sleeves of the upper and lower platforms to couple the upper and lower platforms together at a distance from one another.

17. The bed assembly of claim 16, further comprising one or more garment hooks rotatably mounted onto the bed assembly and rotatable between a use position and a stowage position.

18. The bed assembly of claim 16, further comprising at least one locking footing extensible in a downward direction from the bed assembly and configured to contact a surface and support at least a portion of the weight of the bed on the surface while frictionally resisting movement of the bed laterally across the surface.

19. The bed assembly of claim 16, wherein the recessed storage area is formed by a base shelf and a set of vertical walls extending from a perimeter of the base shelf, the bed assembly further comprising:

two or more dividers extending transversely across the base shelf from opposing vertical walls; and a lockbox formed between two adjacent dividers to securely position items therein.

20. A bed assembly, comprising:

upper and lower platforms, at least one of the upper and lower platforms having a recessed storage area;

a deck pivotably mounted to the at least one platform of the upper and lower platforms having a recessed storage area, the deck being a substantially planar member having opposing longitudinal side edges and being pivotable between a horizontal position wherein a user may lie thereon and a non-horizontal position for access to the storage area by the user; and opposing side guards mounted to the deck along the opposing longitudinal side edges thereof, at least one of the side guards having an aperture therethrough to facilitate gripping of the deck for pivoting thereof relative to the at least one platform.

21. The bed assembly of claim 20, further comprising a plurality of casters to allow for movement of the bed across a surface.

22. The bed assembly of claim 20, further comprising a locking footing extensible in a downward direction from at least one of a pair of base supports and configured to contact a surface and support at least a portion of the weight of the bed assembly on the surface while frictionally resisting movement of the bed laterally across the surface.

23. A bed assembly, comprising:

upper and lower platforms coupled together at a distance from one another by a pair of end frames, at least one of the upper and lower platforms having a recessed storage area, the pair of end frames each having first and second vertical posts and at least one horizontal cross member formed therebetween;

a deck pivotably mounted to the at least one platform of the upper and lower platforms having a recessed storage area, the deck being pivotable between a horizontal position wherein a user may lie thereon and a non-horizontal position for access to the storage area by the user, opposing side guards mounted to the deck, at least one of the side guards having an aperture therethrough to facilitate gripping of the deck for pivoting thereof relative to the at least one platform, the deck being pivotable.

24. The bed assembly of claim 23, wherein the recessed storage area is formed by a base shelf and a set of vertical walls extending from a perimeter of the base shelf.

25. The bed assembly of claim 24 further comprising a lockbox formed in the recessed storage area.

26. The bed assembly of claim 23, further comprising first and second base supports mounted to the lower platform.

27. The bed assembly of claim 26 further comprising at least one locking footing being mounted to at least one of the first and second base supports.

* * * * *